US009398796B2

(12) United States Patent
Kennedy et al.

(10) Patent No.: US 9,398,796 B2
(45) Date of Patent: Jul. 26, 2016

(54) HAIR STYLING DEVICE

(75) Inventors: Sarah J. Kennedy, Union City, NJ (US); Myung-Ho Maeng, Ansan (KR)

(73) Assignee: The Beachwaver Co., Libertyville, IL (US)

( * ) Notice: Subject to any disclaimer, the term of this patent is extended or adjusted under 35 U.S.C. 154(b) by 275 days.

(21) Appl. No.: 13/416,020

(22) Filed: Mar. 9, 2012

(65) Prior Publication Data

US 2012/0240955 A1 Sep. 27, 2012

(51) Int. Cl.

| | |
|---|---|
| ***A45D 2/36*** | (2006.01) |
| ***A45D 1/04*** | (2006.01) |
| ***A45D 1/16*** | (2006.01) |
| ***A45D 2/14*** | (2006.01) |

(52) U.S. Cl.

CPC .. *A45D 1/04* (2013.01); *A45D 1/16* (2013.01); *A45D 2/146* (2013.01)

(58) Field of Classification Search

CPC ..... A45D 6/00; H01R 39/12; H01R 39/643
USPC ..... 132/232–234, 237–239, 241, 226–227, 132/229; 219/222–226, 230, 533; 200/179, 200/336, 564, 567, 569–571; 439/12, 21, 439/25, 22

See application file for complete search history.

(56) References Cited

U.S. PATENT DOCUMENTS

| | | | | |
|---|---|---|---|---|
| 2,477,901 | A * | 8/1949 | Robboy | 174/86 |
| 3,472,242 | A * | 10/1969 | Demner | A45D 40/00 132/333 |
| 3,808,577 | A * | 4/1974 | Mathauser | H01R 13/6205 439/180 |
| D255,606 | S * | 6/1980 | Garcia | D28/36 |
| 4,211,914 | A * | 7/1980 | Jackson | 219/225 |
| 4,829,156 | A * | 5/1989 | Thompson | 219/225 |
| 5,690,498 | A * | 11/1997 | Sobhani | H01R 35/04 439/22 |
| 6,640,814 | B1 * | 11/2003 | Burke | A45D 40/30 132/319 |
| 6,962,498 | B2 * | 11/2005 | Kohen | F21V 21/03 439/21 |
| 2008/0258411 | A1 * | 10/2008 | Miura et al. | 279/128 |
| 2009/0260650 | A1 * | 10/2009 | Jung | 132/224 |

FOREIGN PATENT DOCUMENTS

| | | | |
|---|---|---|---|
| KR | 10-2004-0092957 | | 11/2004 |
| KR | 20-0385754 | Y1 | 6/2005 |
| KR | 20-0394529 | Y1 | 9/2005 |
| WO | WO2007-100842 | A2 | 9/2007 |
| WO | WO2009-086063 | A1 | 7/2009 |

* cited by examiner

*Primary Examiner* — Todd E Manahan
*Assistant Examiner* — Brianne Kalach
(74) *Attorney, Agent, or Firm* — Botkin & Hall, LLP

(57) ABSTRACT

A hair styling device that has a rotating cylinder extending from a body that may be easily grasped by hand. The device allows the cylinder to rotate relative to the body, which remains stationary in the hand of a user. The cylinder has a clamp for clamping hair to the cylinder. The clamp rotates with the cylinder and is used to wind hair up the cylinder while the user holds the body of the device. The direction of rotation of the cylinder may be changed as desired by the user. The ability of a user to rotate the cylinder without rotating the entire device manually eliminates twisting the cord due to turning the entire device as is done with traditional curling irons. Buttons on the device select the direction of rotation of the cylinder.

9 Claims, 4 Drawing Sheets

HAIR STYLING DEVICE

CROSS REFERENCE TO RELATED APPLICATIONS

This application claims the benefit of U.S. Provisional Application No. 61/466,227, filed Mar. 22, 2011, the disclosure of which is hereby incorporated by reference.

BACKGROUND OF THE INVENTION

Traditional curling irons are well known and have problems that make their use difficult to achieve results. A traditional curling iron requires a user to manually rotate the entire iron to curl hair. This requires two hands to twist a traditional iron many times over to rotate a number of full revolutions to curl a length of hair. During this twisting, the cord can easily become tangled. Also, there is a high likelihood of being burned because two hands are being used and there is usually a limited amount of surface area on a traditional iron that is not heated. Ideally, one hand usage and not tangling cords while winding hair on a curling iron cylinder would be a much better system.

SUMMARY OF THE INVENTION

The present invention is a hair styling device that has a rotating cylinder extending from a body that may be easily grasped by hand. The device allows the cylinder to rotate relative to the body, which remains stationary in the hand of a user. The cylinder has a clamp for clamping hair to the cylinder. The clamp rotates with the cylinder and is used to wind hair up the cylinder while the user holds the body of the device. The direction of rotation of the cylinder may be changed as desired by the user.

In another aspect of the invention, the cylinder has a heating element. Because the cylinder rotates relative to the body, supplying electricity to heat the heating element in the cylinder must be done with contacts that provide an electrical connection while rotating. A first terminal disc has contacts within the cylinder and a second terminal disc in the body has contacts. The first terminal disc is fixed with respect to the cylinder and rotates with it. The second terminal disc is fixed within the body. As the cylinder rotates, contacts on both discs remain in contact to supply electricity to the heating element.

DETAILED DESCRIPTION OF INVENTION

Figure 3:
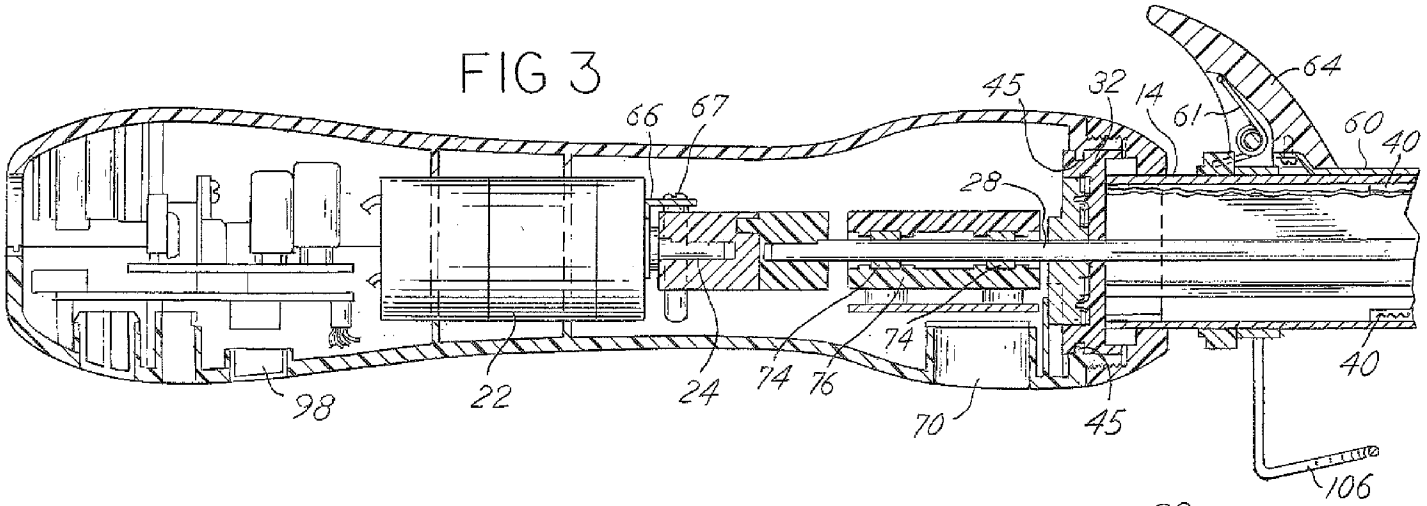
FIG. 3 is a sectional view taken about line 3-3 in FIG. 1.
Figure 4:
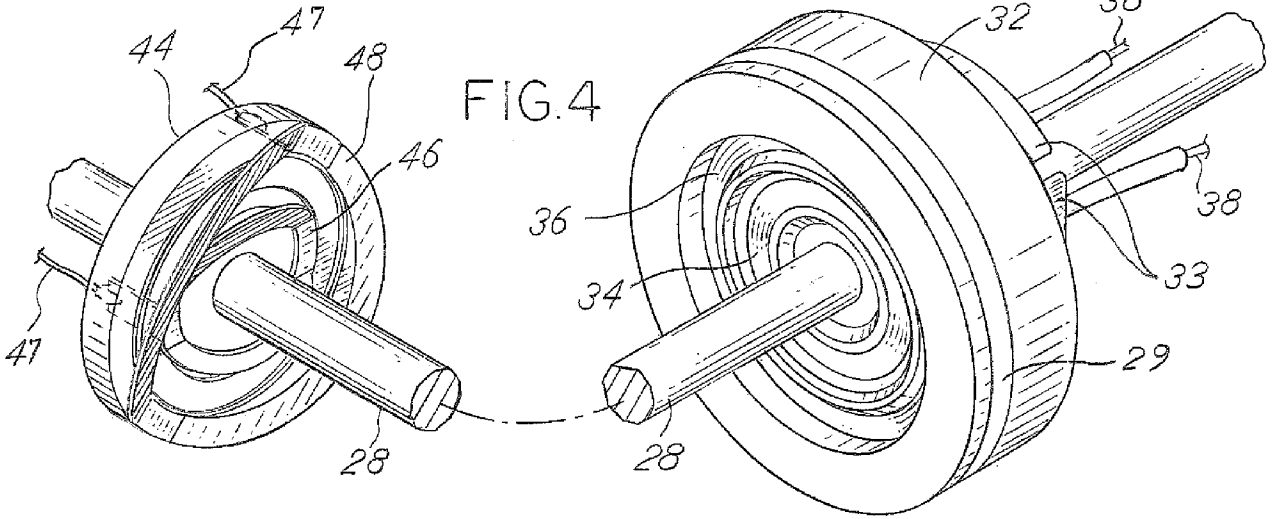
FIG. 4 is a broken away perspective of the terminal discs.

The hair styling device 10 of this invention has a body 12 designed to be comfortably grasped. The body 12 is also designed to contain electrical and mechanical parts that make the device 10 function. A cylinder 14 extends from the body and is rotatable with respect to the body 12. A motor 22 is used to cause the cylinder 14 to rotate relative to the body. The motor shaft 24 is connected to rod 28 that runs the length of the cylinder 14. Rod 28 is threaded at its end 30 opposite motor 22 and includes a first terminal disc 32 that includes inner and outer contacts 34, 36 that are concentric annuli. Each concentric annular contact 34, 36 is affixed concentrically with respect to rod 28 and lies flat within the first terminal disc 32 as shown in FIG. 4. The terminal disc 32 is molded onto rod 28 and rotates with it. The terminal disc 32 includes upwardly extending tabs 33 that fit within the interior of the cylinder 14 and prevent it from rotating with respect to the terminal disc 32. Thus, rotating rod 28 will rotate the cylinder 14. An outer groove 29 is located on the exterior of the first terminal disc 32. Wires 38 connected to the contacts 34, 36 extend from the terminal disc 32 into the cylinder 14 to supply power to heating elements 40 in the cylinder 14. When the device 10 is assembled, cylinder 14 extends from the body 12 and this places the first terminal disc 32 adjacent to a second terminal disc 44. The cylinder 14 is held within the body by ribs 45 that extend inwardly to fit within the outer groove 29 on the first terminal disc 32. The second terminal disc 44 has inner and outer contacts 46, 48. These contacts 46, 48 are each bent upwardly on opposite sides as shown in FIG. 4. Contacts 46, 48 are the same diameter as contacts 34, 36 respectively. Contacts 46, 48 act as springs, which ensure multipoint brushing contact with contacts 34, 36. Wires 47 extend into the body 12 to connect to the electrical supply delivered through cord 49. The second terminal disc 44 is held stationary within the body 12 by rib 50 that extends into a slot 52 within in the body. The ribs 45 can be seen in FIG. 3 and one of the ribs 45 can be seen in FIG. 5. Because the first terminal disc 32 is rigidly affixed to rod 28, this in turn will fix the cylinder 14 to the body 12 because the ribs 45 hold terminal disc 32 within the body and cylinder 14 is held against terminal disc 32 with nut 54 on the end 30 of rod 28. Nut 54 is within end cap 54 that receives end plug 58. The end plug 58 conceals the nut 54 and rod end 30.

The cylinder 14 has a hair clamp 60 near the body 12. The clamp 60 is affixed to the cylinder 14 and is adapted for clamping hair to the cylinder 14. A helical torsion spring biases the clamp 61 against the cylinder 14. A thumb lever 64 is used to open the clamp 60 by pressing it down toward the cylinder 14. The lever 64 is positioned near the body 12 so a user may press the lever 64 toward the body 12 without touching the cylinder 14.

Figure 5:
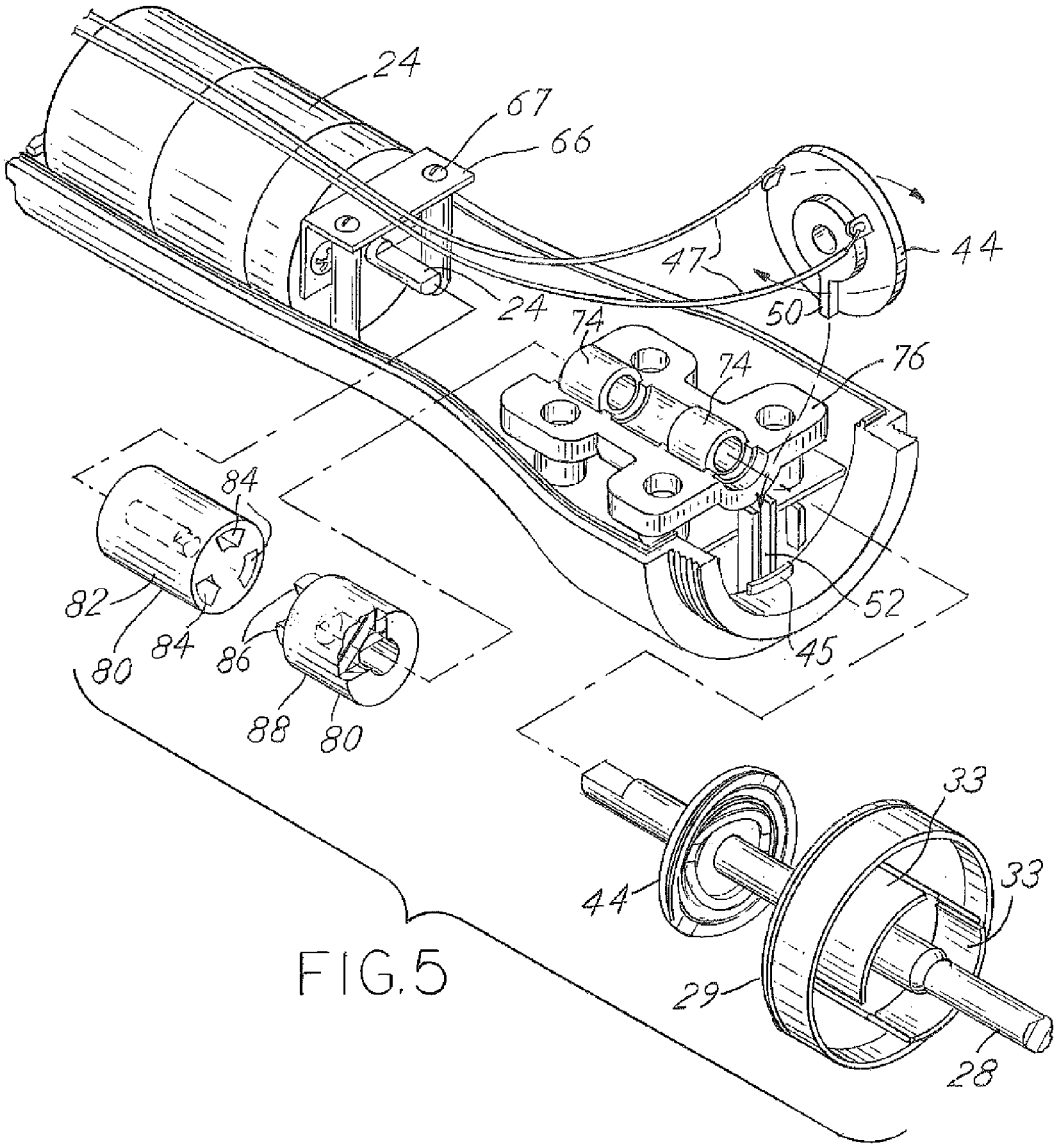
FIG. 5 is an exploded view of the device shown in FIG. 1.

Motor 22 that rotates the cylinder 14 is attached to mounting bracket 66, which is affixed to the body 12 with screws 67. The motor 22 is connected to a power source, which is typically an electrical outlet in a home. The motor 22 is capable of rotating the cylinder 14 in either direction depending on the desire of the user. The motor 22 direction is controlled by pressing one of the directional buttons 68 that determine left or right. The directional buttons 68 are on either side of a go button 70. The user presses the correspondingly marked directional button 68 for left or right to determine which direction the cylinder will rotate. Pressing the go button 70 will make the cylinder 14 rotate after the desired direction is selected. Left is selected for use of the device 10 on the left side of the head and Right is selected for use on the right side of the head so that hair is rotated away from the head. The rod 28 is supported in front of the motor 22 by bushings 74 that are held in a bushing cradle 76. The bushings 74 are low friction bronze and are spaced apart for stabilizing the rod 28 within the body 12. The bushing cradle 76 is fixed to the body as shown in FIG. 5. FIG. 5 shows only half of the bushing cradle 76. The bronze bushings 74 stabilize rod 28 within the bushing cradle 76 to maintain clearance between the first terminal disc 32 and the body 12 adjacent to the terminal disc 32. This maintains the groove 29 in a complementary relationship with ribs 45 so the ribs 45 hold the cylinder 14 to the body 12, with minimal friction. Between the bushing cradle 76 and motor 22 are adapters 80. The adapters 80 are so that the smaller motor shaft 24 and larger rod 28 may be easily joined together. The motor adapter 82 has apertures 84 that accept evenly spaced prongs 86 on the rod adapter 88. This construction facilitates easy assembly due to the fact that rod 28 may be assembled into the body 12 after motor 22 is fastened in place with screws 67 that are driven through motor mounting bracket 66.

The device 10 includes temperature control buttons 96 that are above a main power button 98. The temperature control buttons 96 are used to raise or lower the temperature of the cylinder 14. This is done by the buttons 96 being electrically connected to circuit board 98 that will then, based on what is input, regulate the amount of current that is sent to heating elements 40 within the cylinder 14. The temperature selected through the use of buttons 96 will be displayed on temperature display 102.

Figures 1, 2:
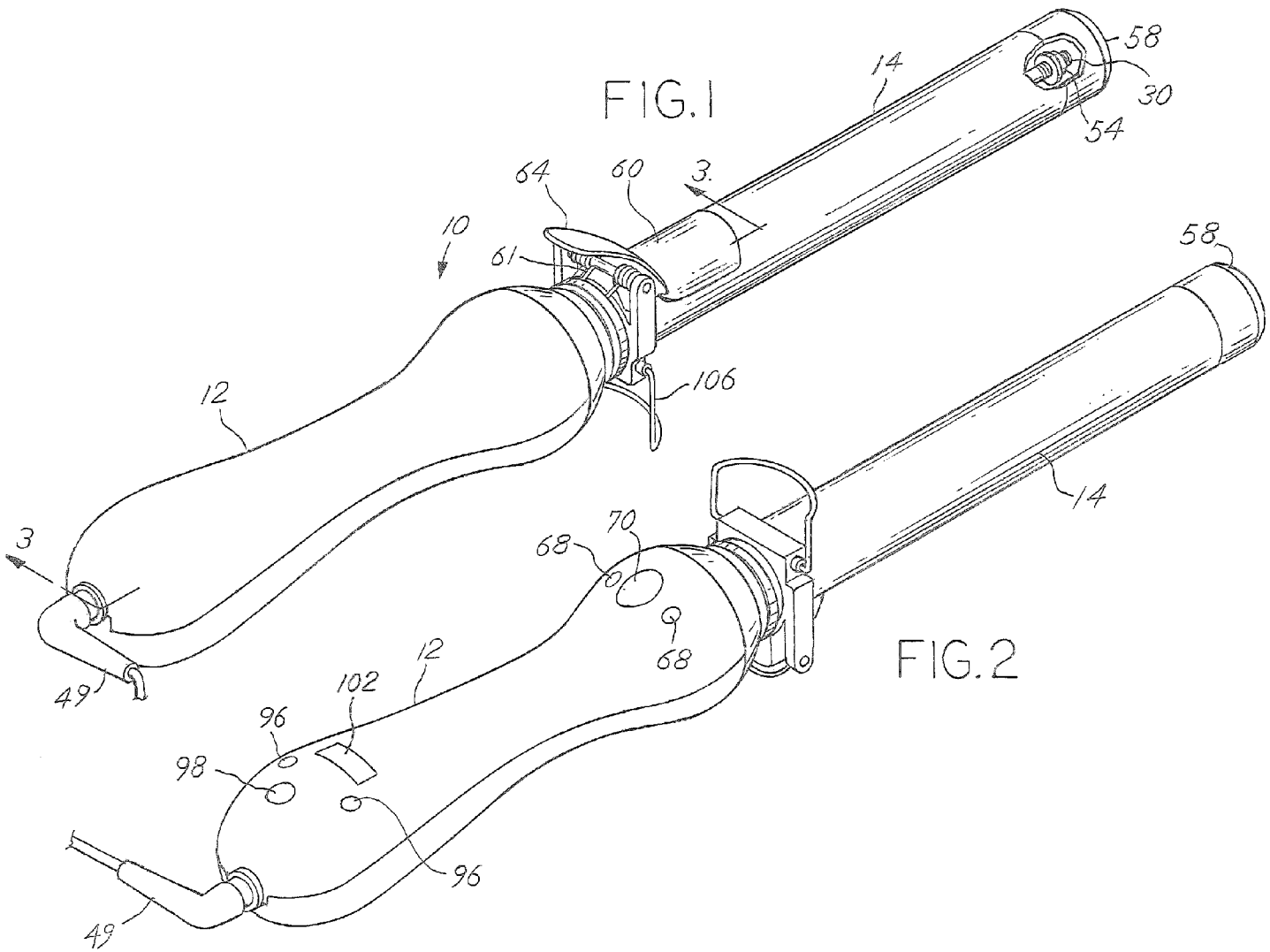
FIG. 1 a perspective of the device.
FIG. 2 is a perspective of the opposite side of the device shown in FIG. 1 showing the opposite side of the body.

A stand 106 is attached to the cylinder 14 as shown in FIG. 1. The stand 106 is an arcuately shaped wire that pivots about its attached ends 108 that extend into a bracket 110 on the cylinder 14. The stand 106 may be used in the extended position shown in FIG. 1 when the device 10 is hot and resting on a surface. During use, the stand 106 may be folded so that it is adjacent to the body.

Figure 6:
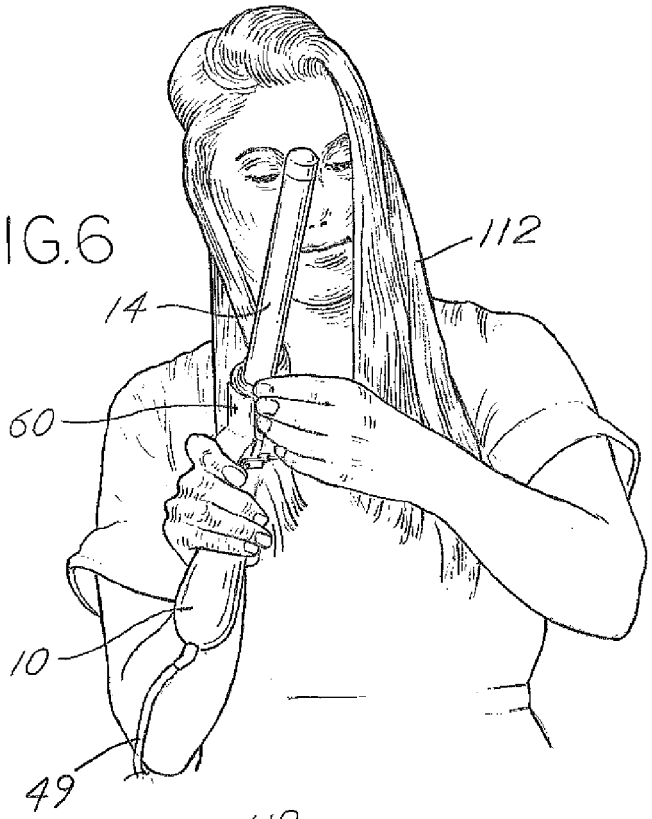
FIG. 6 is a view showing the device being used to start curling hair.
Figure 7:
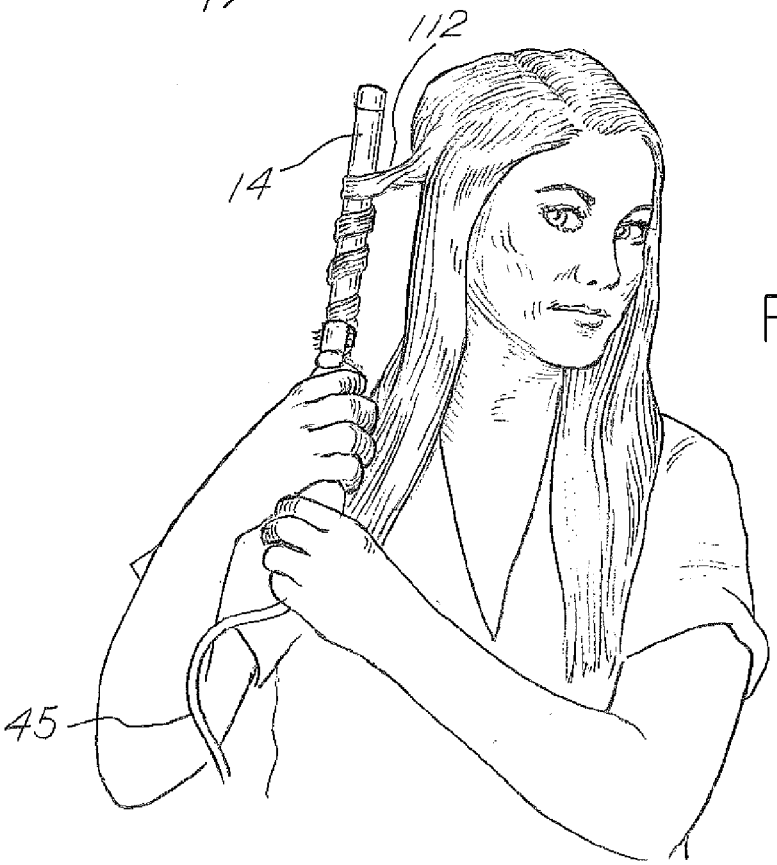
FIG. 7 is a view of the device shown in FIG. 6, showing the device used to finish curling strands of hair wound around the cylinder.

To use the device 10, hair 112 is clamped to the cylinder with clamp 60. The hair 112 is clamped near its ends as shown in FIG. 6. The user then selects the directional button 68 corresponding to the side of the head that the device will be placed on. In FIG. 6, this would correspond to the directional button marked "R" for right. After the corresponding directional button 68 is pressed, the go button 70 is held down so that the cylinder 14 winds the hair 112 near the head. The hair is wound outwardly from the head and doing so requires the rotational direction of the cylinder be changed to accomplish this. The go button 70 is released to stop the cylinder 14 from rotating. With the hair 112 as shown in FIG. 7, the clamp 60 is released. Fingers may be run through the hair to give beautiful waves through the hair 112.

The device is not limited to the details given above, but may be modified within the scope of the following claims.

What is claimed is:

1. A hair styling device comprising:

a body;

a cylinder extending from said body, said cylinder being rotatable relative to said body, said cylinder including a clamp adapted for holding hair, said clamp fixed to said cylinder for rotation with said cylinder, a heating element located within said cylinder;

a rotatable rod affixed to and rotatable with said cylinder relative to said body, said rotatable rod extending into said body and supported by a bearing within said body that restrains lateral movement of said rotatable rod and facilitate rotation of said rotatable rod;

a first terminal disc being rotatably fixed relative to said cylinder, said first terminal disc including concentric electrical annular contacts;

a second terminal disc being fixed relative to said body, said second terminal disc including concentric continuous annular ring electrical contacts, contacts on one of said annular rings are bent upwardly and contacts on other said contact disc are flat annular rings, said first terminal disc being held adjacent to said second terminal disc so that contacts of said first terminal disc remain in contact with contacts of said second terminal disc to provide an electrical circuit across said contacts to said heating element in said cylinder, said rotatable rod extending through centers of both said terminal discs and said contacts of both said terminal discs circumscribing said rotatable rod; and a motor connected to said rotatable rod to rotate said cylinder.

2. The hair styling device as claimed in claim 1, including a rib extending inwardly into a groove on one of said discs that acts thrust bearing preventing axial movement of said one disc.

3. The hair styling device as claimed in claim 2, wherein said thrust bearing is one of said terminal discs.

4. The hair styling device as claimed in claim 3, wherein said thrust bearing includes a channel that receives a tab located on said body to restrain said corresponding terminal disc and therefore said rotatable rod and rotatable barrel are restrained with respect to said body.

5. The hair styling device as claimed in claim 2, wherein one of said terminal discs has an outer diameter that fits within an inner diameter of said other terminal discs, thereby shielding said contacts between said terminal discs and acting as a mechanism for alignment of said terminal discs.

6. The hair styling device as claimed in claim 5, wherein one of said terminal discs includes a ridge located between its corresponding annular electrical contacts to maintain separation of said electrical contacts on both said terminal discs when said discs are adjacent to each other.

7. The hair styling device as claimed in claim 6, wherein one of said terminal discs has an outer diameter that fits within an inner diameter of said other terminal discs, thereby shielding said contacts between said terminal discs and acting as a mechanism for alignment of said terminal discs.

8. The hair styling device as claimed in claim 1, wherein said terminal discs are located between said bearing and said barrel.

9. The hair styling device as claimed in claim 8, including a thrust bearing affixed to said rotatable rod preventing axial movement of said rotatable rod.

* * * * *